United States Patent [19]

Erickson

[11] 4,090,817

[45] May 23, 1978

[54] HIGH DISPLACEMENT-TO-SIZE RATIO ROTARY FLUID MECHANISM

[76] Inventor: Frederick L. Erickson, 2610 Bosworth Dr., Fort Wayne, Ind. 46805

[21] Appl. No.: 691,198

[22] Filed: May 28, 1976

[51] Int. Cl.[2] ..... F04B 29/00

[52] U.S. Cl. ..... 417/462

[58] Field of Search ..... 417/460–463, 417/204; 123/44 D; 418/58, 59

[56] References Cited

U.S. PATENT DOCUMENTS

| | | | |
|---|---|---|---|
| 977,662 | 12/1910 | Levey | 417/462 |
| 1,918,408 | 7/1933 | Lakin-Smith | 417/462 |
| 2,258,379 | 10/1941 | Estey | 417/463 |
| 2,703,675 | 3/1955 | Johnson | 417/463 |
| 3,075,286 | 1/1963 | McVicker et al. | 417/462 |
| 3,168,050 | 2/1965 | Laing | 91/493 |
| 3,279,445 | 10/1966 | Karol | 123/44 D |
| 3,799,035 | 3/1974 | Lamm | 417/462 |
| 3,855,978 | 12/1974 | Becker | 123/44 D |

FOREIGN PATENT DOCUMENTS

| | | | |
|---|---|---|---|
| 183,861 | 4/1955 | Austria | 417/204 |
| 726,556 | 5/1932 | Italy | 417/460 |
| 430,830 | 6/1935 | United Kingdom | 417/462 |

*Primary Examiner*—William L. Freeh

*Attorney, Agent, or Firm*—Gust, Irish, Jeffers & Rickert

[57] ABSTRACT

A positive displacement fluid moving mechanism having internal construction features which allow it to possess a very high ratio of fluid displaced per unit rotation in relation to the volume of the displacing mechanism, whereas, this feature allows increased performance due to less energy required to operate the unit because of its reduced size and internal friction.

7 Claims, 12 Drawing Figures

HIGH DISPLACEMENT-TO-SIZE RATIO ROTARY FLUID MECHANISM

BACKGROUND OF THE INVENTION

The present invention relates to fluid moving mechanisms and more specifically to a rotary fluid mechanism possessing a very high displaced volume to size ratio i.e., the displaced fluid per revolution is large compared to the volume of the mechanism which moves this fluid. The object of a high displacement-to-size ratio fluid mechanism is to obtain less mechanism friction in order to reduce either the power consumption to drive this mechanism as a fluid pump, or to reduce the fluid energy required to operate the device as a fluid motor or meter.

The common prior art positive displacement fluid mechanisms possess relatively higher internal friction or resistance to flow and larger size and weight for equivalent displacement and higher noise levels as represented by the vane, piston, and gear types of fluid mechanisms.

For example, rotary vane fluid mechanisms most commonly consist of a rotor with sliding vanes mounted eccentrically in a circular or elliptical chamber. To keep leakage to an acceptable value the vanes must provide a contact seal to a cam ring introducing friction forces and wear proportional to the number of vanes, the vane sealing surface and size of the cam ring. Typically vane mechanisms exhibit high vane friction and leakage, low efficiency, and require a substantial pressure differential to operate which produces a lateral force on the rotor that is transmitted to the associated shaft and bearings. The vane mechanism has a poor displacement-to-size ratio as compared to the present invention. The aforementioned properties are true for both the fixed and variable-displacement vane type mechanism.

The piston type mechanism can be classified by the basic relationship between the piston and the piston barrel. The axial-piston version, have pistons that lay approximately along the axis of the barrel, whereas, in the radial-piston mechanisms, the pistons radiate outward from the barrels. The axial piston requires the complexity of an angled cam (or wobble) plate or the use of the bentaxis principle and usually require some type of check valve.

The radial-piston version requires a rotating cam that runs through the center of the mechanism imparting reciprocating motion to the pistons. Check valve complexity is also usually required in this configuration.

These basic piston mechanisms and many variations all require piston seals to reduce leakage, have a relatively high resistance to mechanical motion and have higher pressure drops when compared with the present invention. Energy loss due to the normal cyclic motion is also encountered with piston mechanisms and many cylinders are required for smooth operation. The major disadvantages of the piston mechanisms are the large-size, complexity, and higher friction required for performance equal to that of the present invention.

Gear type mechanisms have numerous configurations including gear-on-gear, three-gear, gear-within gear, and screw gear mechanisms and in general, are fixed displacement devices having high bearing loads, high friction and require heavier bearings, housings and shafts as compared to the present invention. Leakage of fluid that can be forced past internal seals between inlet and outlet ports is also very high for the gear type mechanisms. To reduce leakage at the gear interface, high contact forces and high precision are required resulting in increased size, weight and basic resistance of the mechanism. These mechanisms usually exhibit a low displacement-to-size ratio and are generally low pressure devices, have low mechanical efficiency and are noisy in operation.

Another version somewhat similar in characteristics to the gear mechanism is the lobed-rotor mechanism. This mechanism consists of two rotating elements that revolve in opposite directions in a chamber. The rotors usually do not touch and, therefore, have a very high fluid leakage.

Other prior art in rotary mechanisms similar to the invention do not offer the advantage of simple construction, novel porting between rotating chambers and a high displacement-to-size ratio with low mechanical resistance. In general all the prior art in positive displacement mechanisms require larger mechanisms with greater resistance to mechanical motion for the same fluid displacement per shaft revolution.

SUMMARY OF THE INVENTION

The fluid mechanism of the present invention features four interconnected moving parts which form four separate variable volume chambers. These variable volume chambers are interconnected together by proper porting means so that two of the chambers are always in communication together and are expanding in volume, and the other two chambers are always communicating together and are contracting in volume. As the mechanism rotates these chambers will continuously switch communications with each other so as to maintain the two chambers expanding and two chambers contracting relationship. This basic mechanism operates similar to mechanisms covered in Class 417 Subclass 463.

This invention possesses certain very desirable refinements which allows the mechanism to be used for low energy related devices. The primary objective of this invention is to provide a high fluid displacement-to-size ratio which is better than the before mentioned fluid moving devices. High displacement-to-size ratio means that the fluid displaced volume which passes through the mechanism for each revolution of the output shaft is large in comparison to the actual size or volume which the mechanism occupies. This is further interpreted as meaning the smaller the mechanism which is required to move a given amount of fluid through it, the less friction is encountered and the less energy is required for the device to function. This feature applies to motor driven pumps as well as fluid operated motors or meter mechanisms.

This mechanism features construction techniques which allows a high displacement-to-size ratio and yet is economical to manufacture. One construction technique is accomplished by using a compact two piece rotary housing. By using two separate but identical rotary housing parts, an interconnecting or crossover member is eliminated which allows the rotary chamber member which slides between the two rotary housing members to possess a maximum stroke thus giving improved displacement volume in comparison to the mechanism volume.

Accordingly it is one objective of the present invention to provide a mechanism improvement which allows reduced energy to operate it as a fluid motor, meter or pump.

A further improvement to the two piece rotary housing members is to install anti-friction rollers in order to reduce further the moving friction of the rotary housing as it rotates inside the stationary fluid mechanism block. The combination of a separate rotary chamber with rollers allows constant distance roller tracking and no radial fluctuation movement of the strip seals. Since the strip seal slots can be orientated at a constant fixed distance away from the inside block bore, using separate housing members, the seal design can be economically and more simply constructed.

Accordingly it is a still further object of the present invention to provide a fluid mechanism which has reduced friction and simpler construction to improve its energy input/output features and cost advantages through simpler construction.

A second construction technique which further increases the displacement-to-size ratio and reduces the friction is accomplished by providing a low friction sliding means for the rotary piston. A bearing rod which slides through the center of the rotary piston accomplishes this low friction sliding. The rotary piston, therefore, does not make sliding contact with the rotary chamber member, but is guided and slides from one end of the rotary chamber member to the other by means of a centrally located guide rod. This feature allows a higher displacement mechanism than possible with conventional sliding contact between the rotary piston and rotary chamber member.

Accordingly, it is a continued object of this invention to provide a rotary mechanism with increased displacement-to-size ratio which allows lower friction and reduced energy to operate the mechanism.

Another method by which internal fluid shearing and sliding contact friction can be reduced is incorporated into this fluid mechanism by relieving the side walls in certain areas on the top (input) side and bottom (output) side. Relieving these wall areas significantly reduces the friction of the outer sliding members (where the friction is normally the highest) and thus reduces the overall energy input/output requirements of the mechanism. The sidewall relief is provided in an area where the input/output porting functions never communicate together in turn eliminating the tendency to short circuit the fluid through the unit. Additional fluid input/output port area is also provided by incorporating the fluid ports as part of these relieved areas.

Another benefit derived from incorporating the fluid input/output ports into the relieved side plate areas is that the mechanism can be further compacted in size and can result in additional simplicity and reduced cost.

Accordingly, it is yet another object of the present invention to provide a further reduction in internal friction and complexity in order to reduce the energy requirements and also reduce the production cost.

DESCRIPTION OF THE PREFERRED EMBODIMENT

The present invention relates to low friction fluid mechanisms which operate as either a pump, fluid motor or fluid meter (fluid flow measuring mechanism). This invention specifically relates to self starting or constant flow fluid mechanisms which have a displacement volume to mechanism volume ratio of 0.7 and greater. This ratio being a measure of the fluid displaced through the mechanism per one cycle of the mechanism to the volume of the mechanism which displaces the fluid. The described rotary mechanism is a type similar to those in Class 417 Subclass 463, but which possesses several very desirable improvements which allow the mechanism to operate with significantly reduced friction which proportionally reduces the energy required for applications involving a low leakage positive displacement fluid mechanism.

In combination with having construction techniques which allow very low friction losses through a compact mechanism configuration, further reductions in friction are accomplished by relieving all noncritical sealing areas on the end plates. These features are now further described in detail to illustrate the overall energy savings possible by utilizing these features.

All present art classified in Class 417 Subclass 463 consist of a relatively reciprocating piston in which this piston has a second pumping chamber formed integral within which also contributes to the overall pumping ability of the mechanism.

Figure 1:
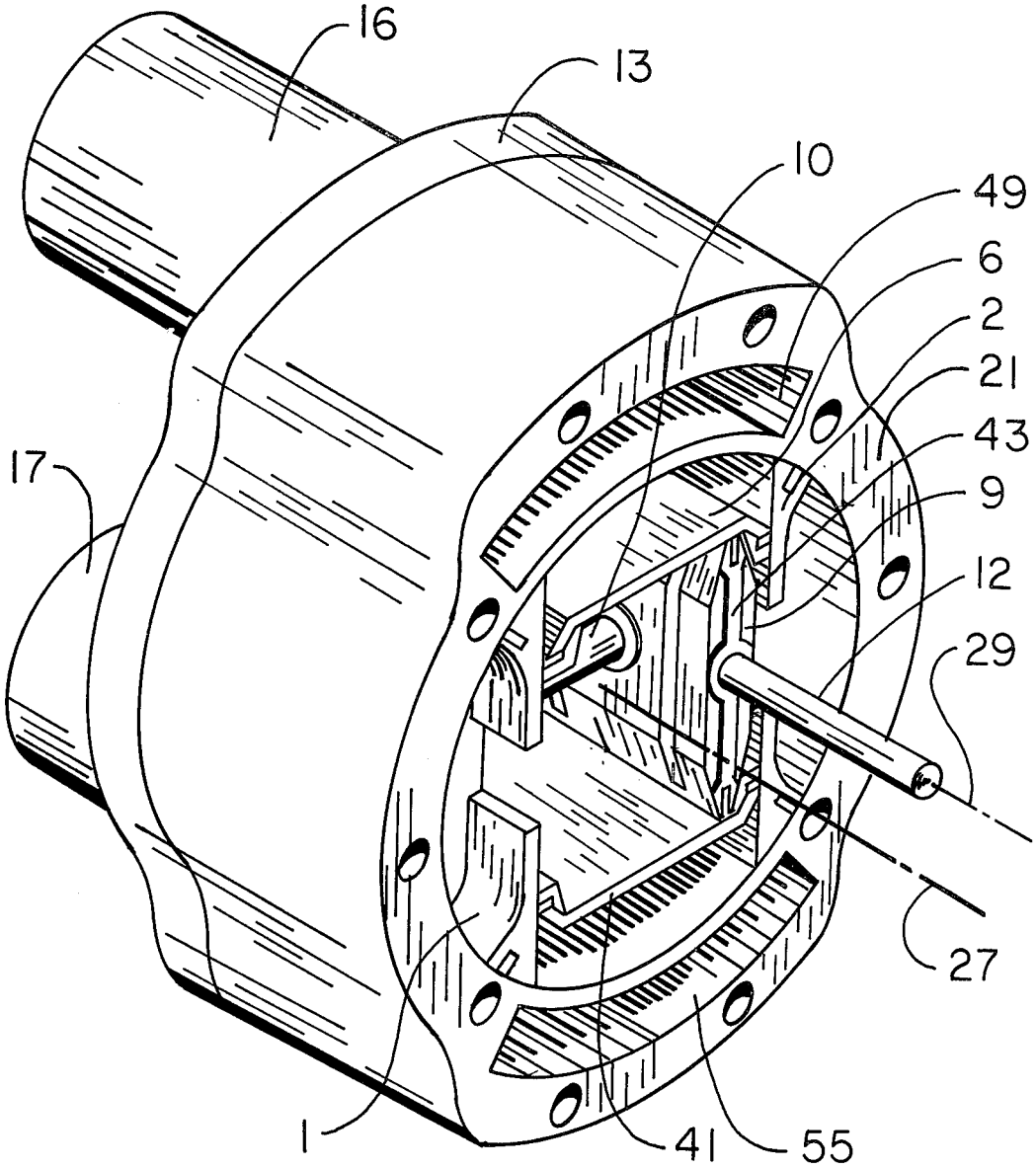
FIG. 1 is a view of the invention with one side plate removed.

FIG. 1 illustrates how the invention is configured with one side plate removed. Notice how the first construction technique of this invention accomplishes maximum displacement volume by allowing the outer rotating pumping chamber to be made up of two independent (identical) parts 1 and 2. These separate parts contain rollers, denoted by 3 and 4 which allow these separate pieces to track around the inside of the circular housing track.

Figure 2:
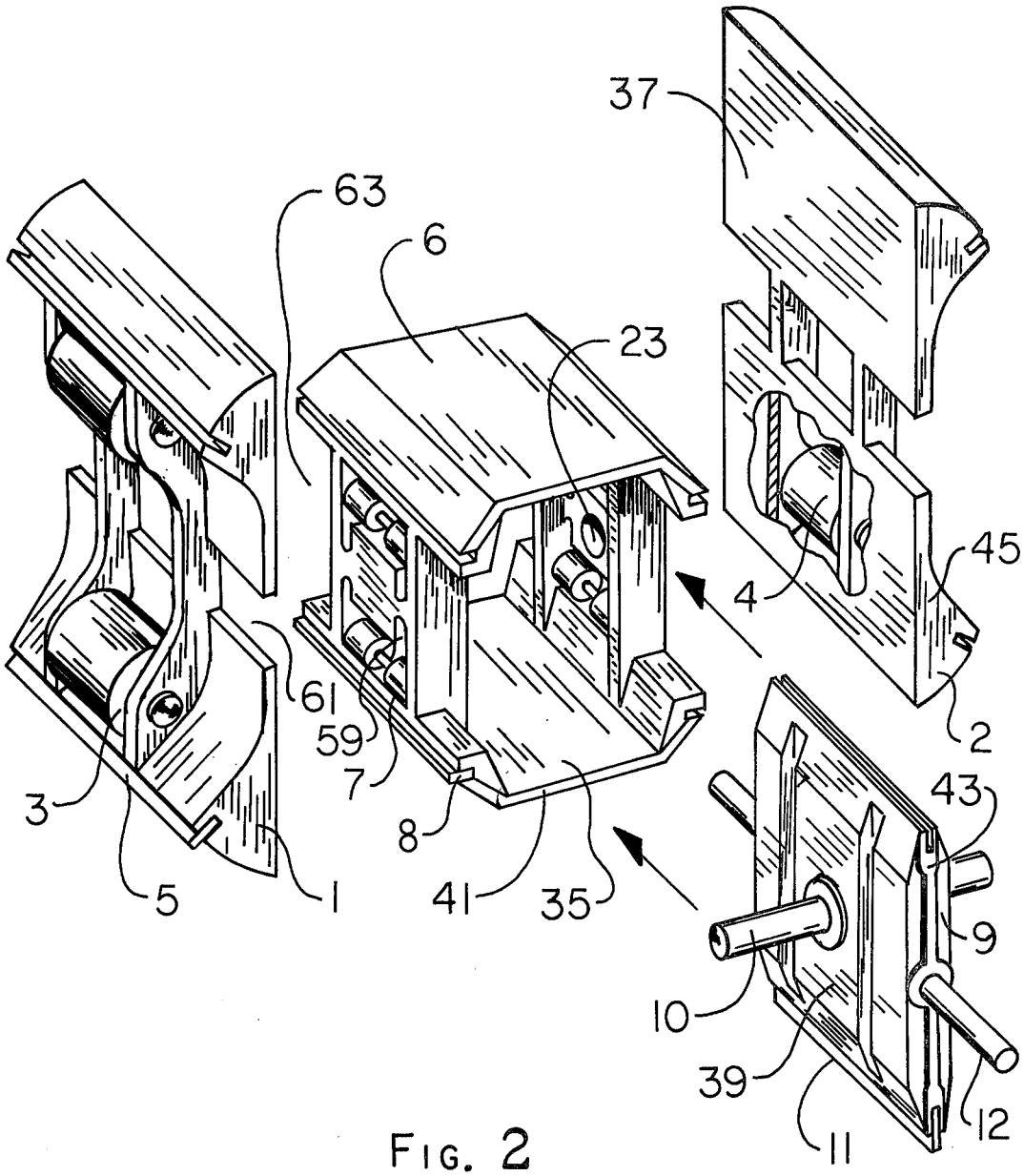
FIG. 2 is a view of the rotating components exploded away from each other to show the two piece outer chamber member, the roller assemblies of this invention and the rod guided rotary piston.

FIG. 2 illustrates the rotating outer pumping chamber parts 1 and 2 surrounding the inner pumping chamber 6. These figures illustrate there are no mechanical connecting arms which fix these two parts together. All prior art illustrates the outer rotating chamber as one piece construction whereby the configuration must be larger in diameter, width or both.

Figure 3:
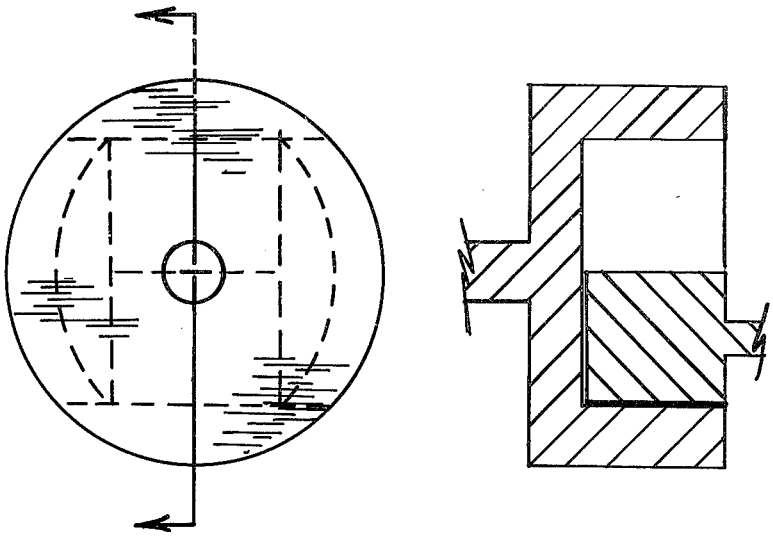
FIG. 3 PRIOR ART
FIG. 3 illustrates a prior art rotary mechanism with side plate connection of the outer rotary housing member.

FIG. 3 illustrates the larger size and corresponding smaller displacement-to-size ratio of a typical prior art fluid mechanism in which the rotating outer chamber member is of one piece construction with a connecting plate located on one side of the rotating chamber member.

Figure 4:
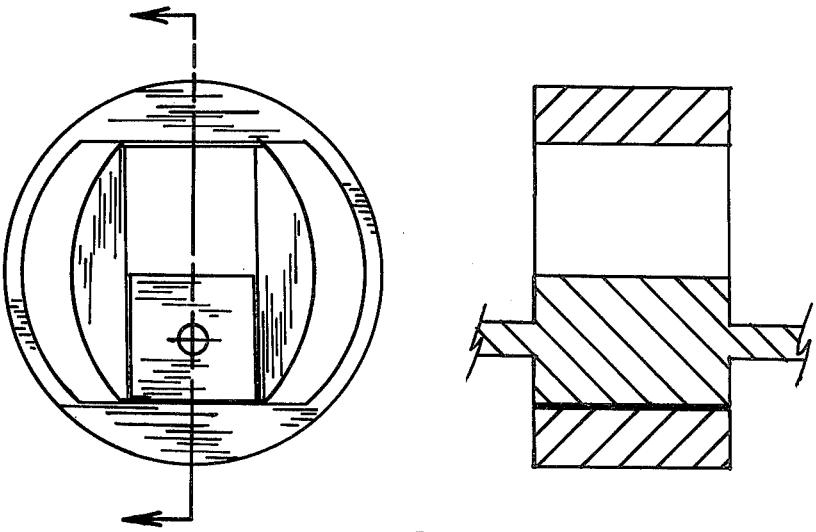
FIG. 4 PRIOR ART
FIG. 4 illustrates a prior art rotary mechanism with circumferential connection of the outer rotary housing member.

FIG. 4 illustrates another common method of attachment in which the rotating chamber member is joined around the outer circumference.

The construction techniques illustrated in FIGS. 3 and 4 require either a larger diameter or a wider pumping mechanism construction in order to displace the same quantity of fluid per revolution as compared to the two piece construction referred to in this invention. Also, these prior art construction techniques result in higher operational friction. Higher friction is encountered with the double rubbing surfaces associated with the side attachment method shown in FIG. 4.

Other undesirable features of these constructions are the greatly increased fluid leakage paths. Double leakage paths are associated with the side plate attachment method and increased leakage results from the larger diameter and longer sealing distances required when using the circumferential attachment method.

The two piece construction utilized for the present invention also has benefits in simplicity of manufacture and is less complex and less costly to manufacture. The main construction advantage is derived from not having to grind internal sealing surfaces such as required in the one piece construction rotating chamber members. It is less involved to manufacture a straight flat sealing surface if this surface is not boxed in or located as an internal flat machined surface.

A further object of this invention is to reduce friction by providing rollers between matting surfaces which experience cyclic dynamic load changes. Also rollers are provided between the inner rotating chamber member 6 and the two outer rotating chamber portions 1 and 2. A typical roller 7 is shown attached to the inner chamber member 6 of FIG. 2. This roller rolls on the flat surface of the outer rotating chamber member 1. Enough rollers are provided between 6 and 1 and 2 in order to eliminate all sliding contact between these members with the exception of the thin low friction strip seals 8. Since the side plates do not experience any loading they require only close fitting surfaces in order to accomplish optimum sealing for typical medium pressure pump or motoring applications.

The second construction technique which yields an even higher displacement-to-size ratio is provided by allowing the rotary piston 9 of FIG. 2 to slide on and be guided by the center slide or piston guide rod 10. The center rod 10 is rigidly connected to the ends of the inner rotary chamber member in apertures such as 23 as shown in FIG. 2. The object of the rotary piston 9 sliding on this center rod 10 is to allow the inner chamber member to be much wider. This is accomplished since the rotary piston can be much narrower at the top because it does not need sliding guidance between itself and the inner chamber member. Also since the inner rotary chamber member does not have to provide sliding bearing contact area for the rotary piston 9, the inner chamber member can be wider and arched down on the ends to provide maximum stroke and avoid external interference contact with the stationary block or housing 21. The top and bottom of the rotary piston 9 never directly contact the top and bottom of the inner rotary chamber member 6 because it is positioned and guided back and forth by the center guide rod 10. Note that strip seals such as 11 disposed in slots in the piston 9 do contact the inner rotary chamber member to provide proper sealing between the chambers separated by the rotary piston. Similar strip seals such as 5 are provided in slots in the outer chamber member 1 and 2 for sealing against the cylindrical housing interior.

Figure 5:
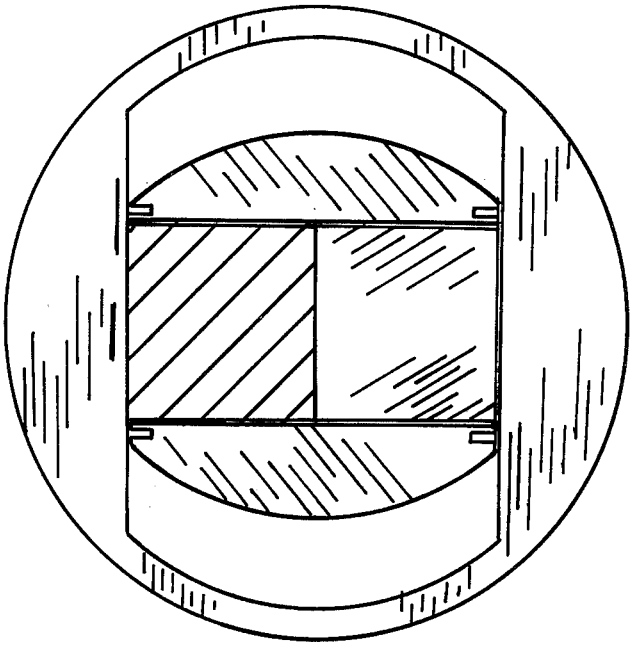
FIG. 5 PRIOR ART
FIG. 5 is a conventional rotary mechanism which does not possess a two piece outer chamber member or rod guided rotary piston.
Figure 6:
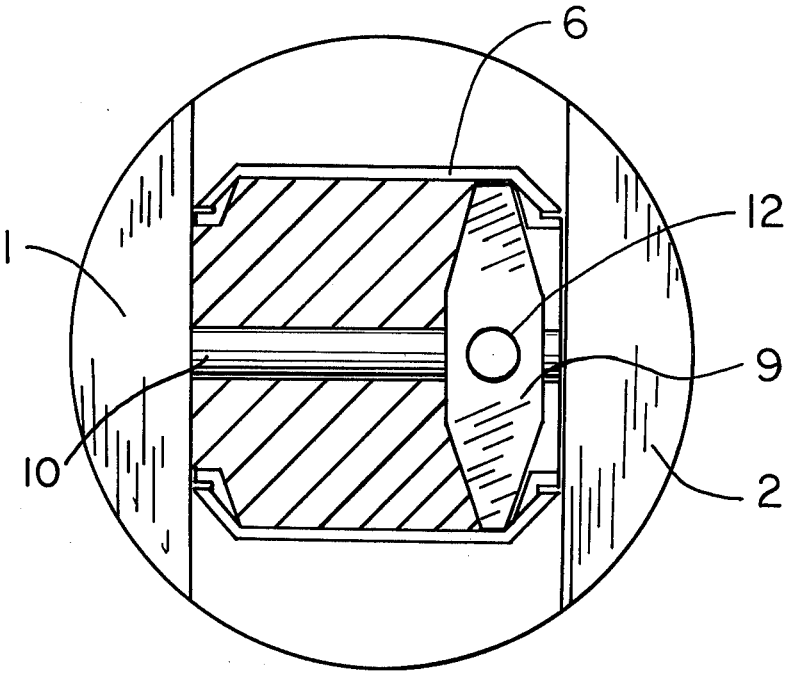
FIG. 6 is an illustration of the present invention with a two piece outer chamber member and a rod guided rotary piston.
Figure 7:
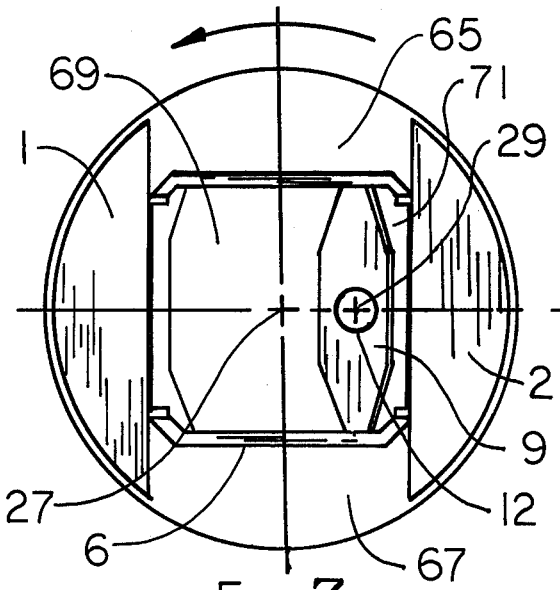
FIG. 7 is an illustration of the present invention.

The prior art mechanisms which do not feature the separate outer chamber member and center sliding rod for the rotary piston have a maximum displacement-to-size ratio of less than 0.6. This conventional mechanism is shown in FIG. 5; as a method of comparison, FIG. 6 illustrates the present invention with a two piece outer chamber member and the rod guided rotary piston. The present invention as illustrated has a displacement-to-size ratio of 0.95.

FIG. 7 through 10 pictorially illustrate how the component parts of the present invention work together as the mechanism rotates through angular increments of 45°. Note, the width of the inner chamber member is about the same as the height of the rotary piston in order to allow all four variable volume chambers to be equal in potential volume. The volume occupied by the piston guide rod must be taken into consideration if it is desired that all four chambers are exactly equal in volume, for example, for metering purposes.

Figure 11:
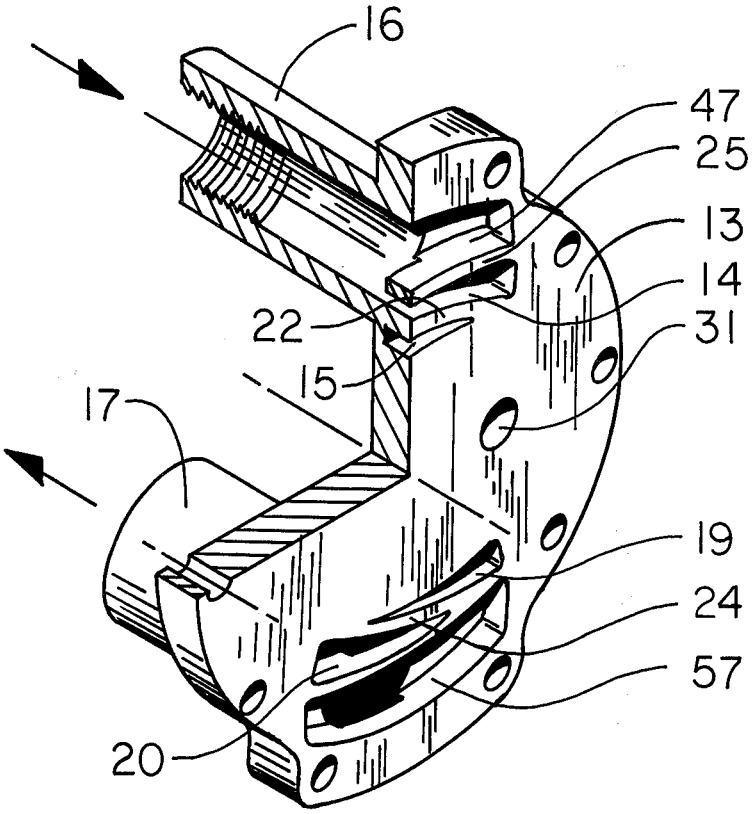
FIG. 11 is a view of the inside surface of the inlet/-outlet porting side plate.
Figure 12:
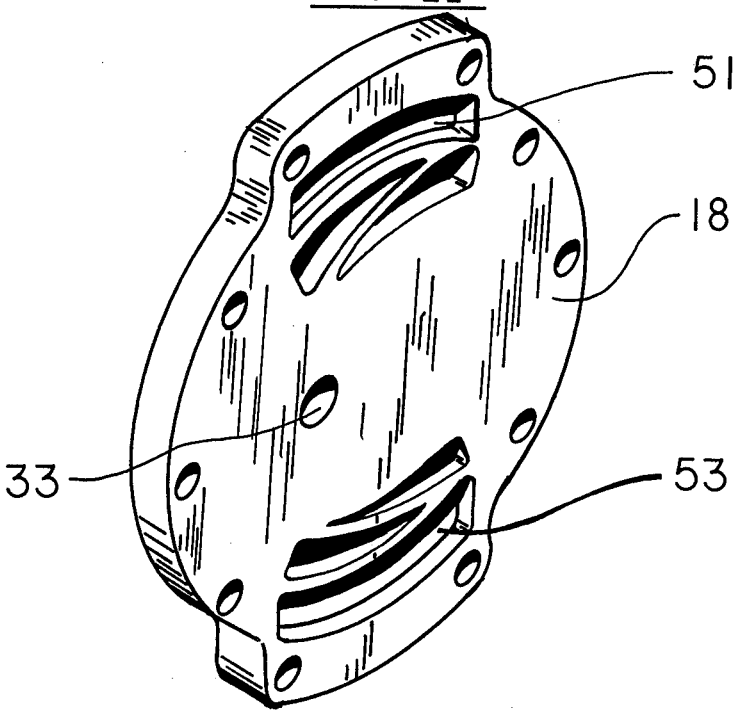
FIG. 12 is a view of the inside surface of the non inlet/outlet porting side plate.

FIG. 11 and 12 pictorially illustrate how the side or end plates Nos. 13 and 18 can be ported and provide cut outs such as 14, 15, 19 and 20 in order to reduce the sliding friction between the side plates and rotating components to a minimum.

The combination of the friction reducing cut outs, together with the input/output conduits 16 and 17, provide a unique means of achieving lower friction, together with providing an extremely compact means of inducing the fluid into and out of the mechanism. As illustrated in FIGS. 11 and 12, it is important to provide ribs such as 22 and 24 between the port holes in order to contain the strip seals located in the inner and outer rotating chamber members. Notice the symmetrical curved rib 25 is for the purpose of containing the outer rotating chamber member seals and the radial spiraling rib such as 22 provided to contain the inner rotating chamber member seal.

Referring now to FIGS. 1, 2, 11 and 12, the rotary mechanism of the present invention may be summarized as including a stationary housing 21 having a generally cylindrical interior extending axially along the axis 27 between the substantially flat generally parallel end portions which are, of course, the visible faces of the end plates 13 and 18 of FIGS. 11 and 12. A first chamber means or member comprising the separate individual portions 1 and 2 rotates within the housing 21 about the axis 27 with the portions of the first chamber means held together to form the chamber solely by the housing interior and held apart to form that chamber by a second chamber means or member 6. A power transfer axle or shaft 12, which is of course concentric with the power transfer axis 29, is fixed within the housing and is journaled in the respective end plates in apertures 31 and 33. Note that the power transfer axis 29 is displaced from the cylinder axis 27 . The piston 9 is, therefore, supported within the cylinder by the shaft 12 for rotation about the axis 29. A second chamber 6 reciprocates within and rotates with the first chamber member 1 and 2 and this second chamber member 6 defines by its interior surfaces such as 35 a chamber for relative reciprocation of the piston 9 therein. A piston guide rod 10 is fixed within the chamber member 6 to slidingly connect the piston within the second chamber 6 to support and align the piston 9 within that chamber member. A first plurality of rollers such as 3 and 4 support the first chamber member in rolling engagement with the housing cylindrical interior and a second plurality of rollers such as 7 supported on the second chamber member rollingly engage the interior surfaces such as 37 of the first chamber member. A plurality of strip seals for sealing against the cylindrical interior are associated with the first and second chamber members and the piston and are identified as 5, 8, and 11 respectively. These strip seals minimize fluid leakage between chambers. Chamber sealing is completed against the end plates by surface seal material such as 43 on the piston 9 and similar materials on the edges 41 of chamber member 6 and 45 of the chamber member portions 1 and 2.

The piston 9 has a pair of opposed working faces such as 39 which in conjunction with interior walls such as 35 of the second chamber member define a pair of chamber portions 69 and 71 of FIGS. 7, 8, 9 and 10 and reciprocation of the piston 9 within the second chamber member expands the chamber portion 69 while contracting chamber portion 71 on the one hand, and expands chamber portion 71 and contracts chamber portion 69 on the other. Similarly, the opposed working faces of the second chamber member in conjunction with interior walls such as 37 of the first chamber member portions 1 and 2 define the chamber portions 65 and 67 of FIGS. 7, 8, 9 and 10 with reciprocation of the second chamber member expanding one of the last mentioned chambers while contracting the other in an alternate manner. Thus, rotation of the power transfer shaft 12 which transfers motion between the rotary mechanism and an external device on the one hand and rotation of the first chamber means 1 and 2 in the housing 21 and relative reciprocation of both the second chamber means 6 and the piston 9 on the other hand, occur together and in a precisely determined ratio.

For example, the shaft 12 might be coupled to a counter or metering device to determine a quantity of fluid passing in inlet 16 and out the outlet 17. The fluid would pass into inlet 16 and by way of opening 47 in the housing end portion 13 be fed to a conduit 49 which passes through the length of the housing to communicate with a similar opening 51 in housing end portion 18 thereby supplying this fluid through both end plates via similar input or inlet ports 14 and 15. Further, the interior portion of the conduit 49 may be slotted or otherwise apertured to allow even greater unrestricted fluid flow into the chamber adjacent to the inlet ports. Diametrically opposed to this chamber will be a second chamber communicating with outlet ports such as 20 and 19 in each end plate and, for example, the fluid flowing into the outlet port in end plate 18 is conveyed by way of opening 53 and conduit 55 to a further opening 57 which communicates with the outlet 17. Thus, fluid is sequentially supplied to and received from chambers defined by the opposed working faces of the piston 9 and the interior of the second chamber member 6 on the one hand and to and from chambers defined by the opposed working faces of the second chamber member 6 and the interior of the first chamber member portions 1 and 2 on the other hand. Fluid flow to and from the chamber containing the piston 9 within the chamber member 6 is easily achieved by providing a number of fluid flow paths 59, 61 and 63 of FIG. 6, however many other fluid flow paths could be devised.

Thus while the present invention has been described with respect to a specific preferred embodiment, numerous modifications will suggest themselves to those of ordinary skill in the art and accordingly the scope of the present invention is to be measured only by that of the appended claims.

I claim:

1. A rotary mechanism comprising:

a stationary housing having a general cylindrical interior extending axially between substantially flat generally parallel end portions;

first chamber means rotatable in the housing about the cylinder axis;

a power transfer axis displaced from the cylinder axis;

a piston supported within the cylinder for rotation about the power transfer axis;

second chamber means reciprocable within the rotatable with the first chamber means, said second chamber means defining a chamber for relative reciprocation of said piston;

the first chamber means comprising separate individual portions confined to form a chamber for the second chamber means solely by the housing interior and held apart to form the chamber for the second chamber means solely by the second chamber means; and a piston guide rod slidingly connecting the piston and second chamber means to support and align the piston within the second chamber means.

2. A rotary mechanism comprising:

a stationary housing having a generally cylindrical interior extending axially between substantially flat generally parallel end portions;

first chamber means rotatable in the housing about the cylinder axis;

a power transfer axis displaced from the cylinder axis;

a piston supported within the cylinder for rotation about the power transfer axis;

second chamber means reciprocable within and rotatable with the first chamber means, said second chamber means defining a chamber for relative reciprocation of said piston;

and a piston guide rod slidingly connecting the piston and second chamber means to support and align the piston within the second chamber means, the piston guide rod extending in a direction generally perpendicular to the power transfer axis and being fixed at its opposite ends in the second chamber means with the piston reciprocably slidable therealong.

3. A rotary mechanism comprising:

a stationary housing having a generally cylindrical interior extending axially between substantially flat generally parallel end portions;

first chamber means rotatable in the housing about the cylinder axis;

a power transfer axis displaced from the cylinder axis;

a piston supported within the cylinder for rotation about the power transfer axis;

second chamber means reciprocable within and rotatable with the first chamber means, said second chamber means defining a chamber for relative reciprocation of said piston;

a first plurality of rollers supported on the first chamber means for rollingly engaging the housing cylindrical interior;

a second plurality of rollers supported on the second chamber means for rollingly engaging the first chamber means interior; and a plurality of strip seals associated with the first and second chamber means and the piston for minimizing fluid leakage between chambers in the mechanism.

4. A rotary mechanism comprising:

a stationary housing having a generally cylindrical interior extending axially between substantially flat generally parallel end portions;

first chamber means rotatable in the housing about the cylinder axis;

a power transfer axle disposed within the housing;

a piston supported within the cylinder for rotation about the power transfer axle;

second chamber means reciprocable within and rotatable with the first chamber means, said second chamber means defining a chamber for relative reciprocation of said piston;

a fluid inlet port means in the opposed housing end portions for supplying fluid to an adjacent chamber;

fluid outlet port means in the opposed housing end portions for receiving fluid from an adjacent chamber;

the inlet and outlet port means encompassing substantially all areas of the inside surface of the respective end plates except those areas in which short circuiting of the fluid from the inlet to the outlet would occur and except those areas contributing effective sealing between the inlet and outlet.

5. A rotary mechanism comprising:

a stationary housing having a generally cylindrical interior extending axially between substantially flat generally parallel end portions;

first chamber means rotatable in the housing about the cylinder axis;

a plurality of rollers supported on the first chamber means for rollingly engaging the housing cylindrical interior;

a power transfer shaft displaced from the cylinder axis for transferring motion between the rotary mechanism and an external device;

a piston having a pair of opposed working faces and supported within the cylinder for rotation about the power transfer shaft;

second chamber means having a pair of opposed working faces said second chamber means reciprocable within and rotatable with the first chamber means, said second chamber means defining a chamber for relative reciprocation of said piston in a direction generally perpendicular to the direction of reciprocation of the second chamber means relative to the first chamber means;

rotation of the power transfer shaft to transfer motion between the rotary mechanism and an external device on the one hand, and rotation of the first chamber means in the housing and relative reciprocation of both the second chamber means and the piston on the other hand occurring together.

6. The mechanism of claim 5 further comprising:

a fluid inlet port in one of the end portions for supplying fluid to a chamber adjacent thereto;

a fluid outlet port in one of the end portions for receiving fluid from a chamber adjacent thereto;

the fluid inlet port and fluid outlet port being symmetrically diametrically opposed to sequentially supply fluid to and receive fluid from chambers defined by the opposed working faces of the piston and the second chamber means interior on the one hand and to and from chambers defined by the opposed working faces of the second chamber means and the first chamber means interior on the other hand.

7. The mechanism of claim 6 wherein the first chamber means comprises separate individual portions confined to form a chamber for the second chamber means solely by the housing interior and held apart to form the chamber for the second chamber means solely by the second chamber means.

* * * * *

UNITED STATES PATENT AND TRADEMARK OFFICE

CERTIFICATE OF CORRECTION

PATENT NO. : 4,090,817

DATED : May 23, 1978

INVENTOR(S) : Frederick L. Erickson

Figure 8:
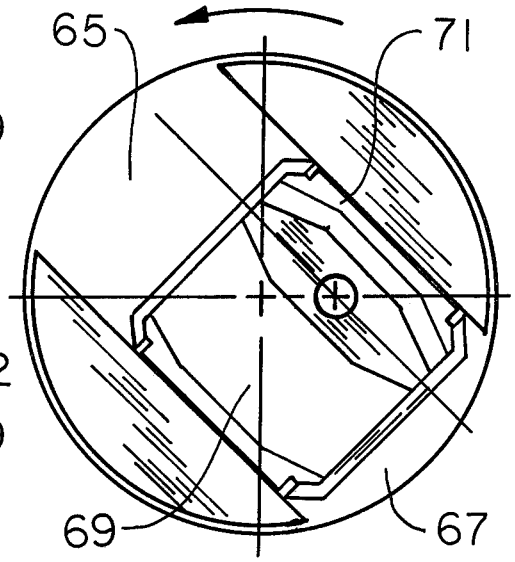
FIG. 8 is an illustration of the present invention rotated 45° from the FIG. 7 position.
Figure 9:
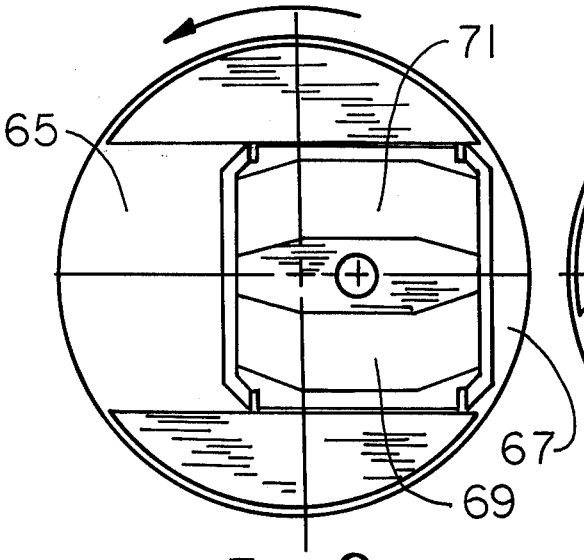
FIG. 9 is an illustration of the present invention rotated 90°.
Figure 10:
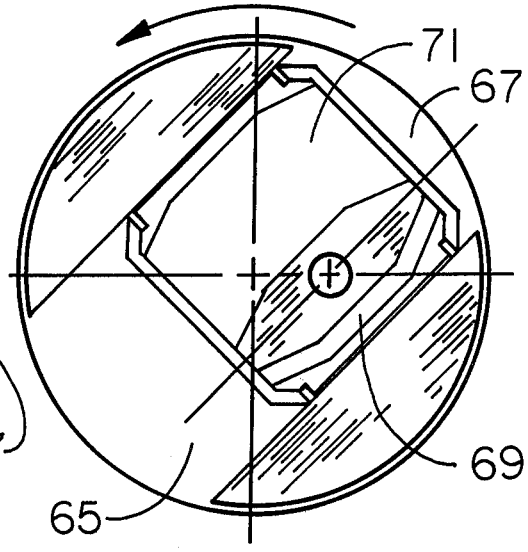
FIG. 10 is an illustration of the present invention rotated 135°.

It is certified that error appears in the above-identified patent and that said Letters Patent are hereby corrected as shown below:

Column 7, line 63, "Fig. 6" should be ---Fig. 8---.

Column 8 (Claim 1), line 13, "the" should be ---and---.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*